US005749327A

United States Patent [19]

Kim

[11] Patent Number: 5,749,327

[45] Date of Patent: May 12, 1998

[54] METHOD FOR CONTROLLING GAS SUPPLY OF A GAS BOILER

[75] Inventor: Si-Hwan Kim, Seoul, Rep. of Korea

[73] Assignee: Daewoo Electronics Co., Ltd., Seoul, Rep. of Korea

[21] Appl. No.: 753,888

[22] Filed: Dec. 2, 1996

[30] Foreign Application Priority Data

Nov. 30, 1995 [KR] Rep. of Korea ..... 1995-45951

[51] Int. Cl.[6] ..... F22B 5/00

[52] U.S. Cl. ..... 122/13.1; 126/351; 126/374; 126/350 R; 236/20 R; 431/6; 431/62; 431/63

[58] Field of Search ..... 431/62, 6, 63; 126/374, 350 R, 351; 236/20 R; 122/13.1

[56] References Cited

U.S. PATENT DOCUMENTS

| | | | |
|---|---|---|---|
| 2,909,218 | 10/1959 | Matthews | 431/62 |
| 2,955,423 | 10/1960 | Perle | 431/62 |
| 3,001,574 | 9/1961 | Runninger | 431/62 |
| 3,169,047 | 2/1965 | Osburn, Jr. | 431/62 |
| 3,171,468 | 3/1965 | Sparrow | 431/62 |
| 4,034,911 | 7/1977 | Baysinger et al. | 236/20 R |
| 4,087,231 | 5/1978 | Matthews | 431/59 |
| 4,261,508 | 4/1981 | Broach | 236/20 R |
| 4,416,256 | 11/1983 | Korwill | 126/374 |
| 5,085,573 | 2/1992 | Geary | 431/6 |
| 5,169,063 | 12/1992 | Miyazaki et al. | 431/6 |

*Primary Examiner*—Henry A. Bennett
*Assistant Examiner*—Jiping Lu
*Attorney, Agent, or Firm*—Beveridge, DeGrandi, Weilacher & Young LLP

[57] ABSTRACT

A method for gas supply pressure control is disclosed. Gas is supplied to a gas burner at a gas supply pressure which is higher than an ignition pressure, and after the ignition of the gas burner, the gas supply pressure increases during a predetermined time until fluid to be heated reaches a target temperature. The increase of the gas supply pressure is performed gradually according to a predetermined number of pressure levels set between the ignition pressure and maximum gas supply pressure of the gas boiler. If the fluid reaches the target temperature, the gas is supplied according to a corresponding to the target pressure temperature. Since the time that the gas is supplied at the maximum gas supply pressure is reduced during the time of initial operation of the gas boiler and during the operation of the gas boiler, the noise resulting from combustion is reduced.

7 Claims, 5 Drawing Sheets

METHOD FOR CONTROLLING GAS SUPPLY OF A GAS BOILER

BACKGROUND OF THE INVENTION

1. Field of the Invention

The present invention relates to a method for controlling gas supply of a gas boiler, and more particularly, to a method for controlling gas supply in order to reduce a noise generated at the time of initial operation or during the operation.

2. Prior Art

Since a gas boiler has advantages of convenience during use, protection of the environment, and so forth, the use of the gas boiler is increasing. The gas boiler has a gas tank for containing gas, a gas burner for heating a fluid by igniting the gas supplied from the gas tank, a gas valve disposed between the gas tank and the gas burner for controlling gas supply pressure, and a microprocessor for controlling the overall operation thereof. When a user sets a target temperature required for heating, the microprocessor controls the gas supply, ignition, and combustion, etc., to keep the target temperature constant.

The methods for controlling gas supply in a gas boiler are classified into two types —on/off control and proportional combustion control. The on/off control method keeps the target temperature constant by controlling the time rate of on-time and off-time which are the times that the gas is supplied and not supplied respectively. Such a method has shortcomings that operations to ignite and to extinguish may occur too often, and then the consumption of gas is increased. Thus a proportional combustion control method which does not have such shortcomings was proposed.

FIG. 1 shows a variation of gas supply pressure according to the proportional combustion control method and FIG. 2 shows the variation of the temperature of water in the gas boiler when the gas supply pressure is controlled as shown in FIG. 1. At the beginning point to of the operation of the gas boiler, the gas is supplied to the gas burner with the maximum gas supply pressure Pmax, and water is heated by maximum heating capacity of the gas boiler. Thus, as shown in FIG. 2, temperature of water rises by degrees, and reaches the target temperature Ts1 as heating operation goes on. As the temperature of water reaches the target temperature Ts1, controlling of gas supply according to a proportional combustion control method begins. That is, gas supply pressure is lowered to a pressure Pm which is pertinent to keep the present target temperature Ts1, and if the present temperature varies while the gas is supplied according to the lowered pressure Pm, gas supply pressure will fall or rise a little to keep the target temperature Ts1.

As described above, since the gas is supplied with the maximum gas supply pressure Pmax at the time of initial operation of the gas boiler and the gas supply pressure is controlled according to the proportional combustion control method, the target temperature is maintained continuously. Furthermore, if the target temperature is heightened by the users during the operation of the gas boiler, the gas boiler is controlled to supply gas at the maximum gas supply pressure Pmax in order to reach the increased target temperature Ts1 rapidly. When the temperature of water reaches the heightened target temperature, the gas boiler is controlled according to the proportional combustion control method again.

However, in the conventional methods for gas supply control, since the gas was supplied with the maximum gas supply pressure Pmax at the time of initial operation of the gas boiler irrespective of the target temperature Ts1 set by user, there is a problem that a noise is generated during the combustion of the gas. The noise may be generated when the user heightens the target temperature during the operation of the gas boiler, because the gas is supplied at the maximum gas supply pressure Pmax. Furthermore, due to the increase in consumption of warm water, since there is a tendency to adopt a gas boiler with greater heating capacity than is needed, the noise due to the combustion of gas at the maximum gas supply pressure Pmax becomes louder. Particularly, the noise may cause disturbance of an individual's sleep in the night.

SUMMARY OF THE INVENTION

The present invention has been proposed to overcome the above described problems in the prior art, and accordingly it is an object of the present invention to provide a method for controlling gas supply pressure in order to reduce noise generated at the time of initial operation and thereafter during the operation of the gas boiler by supplying the gas at the maximum gas supply pressure thereof.

To achieve the above object, the present invention provides a method for controlling gas supply of a gas boiler comprising the steps of: supplying gas into a gas burner at a gas supply pressure which is higher than an ignition pressure for igniting the gas; igniting the gas supplied into said gas burner; gradually increasing the gas supply pressure during a predetermined time until a fluid to be heated reaches a target temperature set by a user, when the gas supplied into said gas burner is ignited; and supplying the gas at a corresponding gas supply pressure to the target temperature when a temperature of the fluid reaches the target temperature.

It is preferable that the gas supply pressure is increased according to pressures set to be a predetermined number of pressure levels which are between the ignition pressure and a maximum gas supply pressure of the gas boiler.

It is preferable that the pressure level is an average pressure of the ignition pressure and the maximum gas supply pressure in order to attain the target temperature quickly in combination with a reduction in noise.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter the present invention will be described in detail with reference to the drawings.

Figure 3:
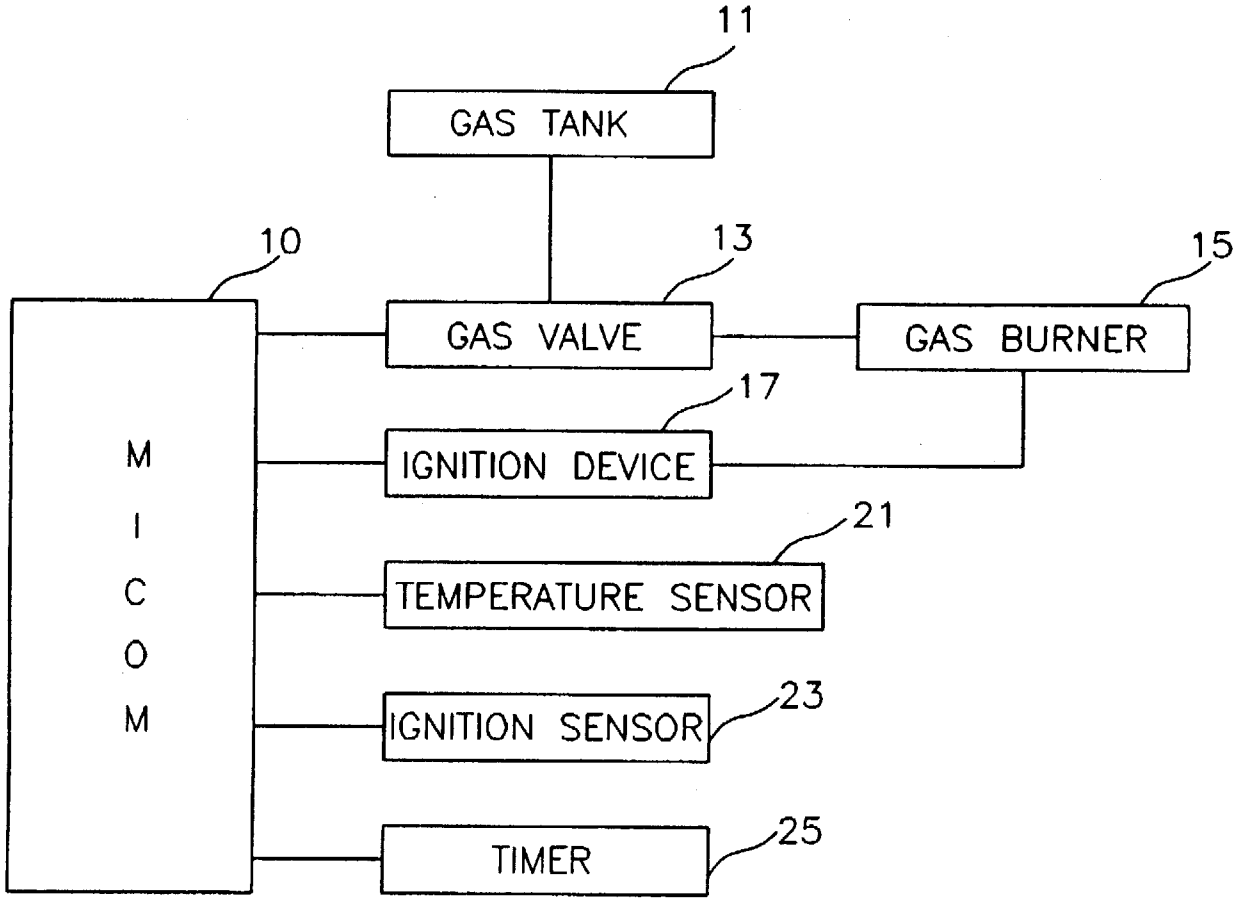
FIG. 3 is a block diagram showing the configuration of the gas boiler according to the present invention.

FIG. 3 is a block diagram showing the configuration of the gas boiler according to the present invention. The gas boiler has a gas tank 11 for containing gas to be ignited, a gas burner 15 for performing combustion of the gas supplied from the gas tank 11, an ignition device 17 for igniting the gas in the gas burner 15, a temperature sensor 21 for sensing the temperature of the water heated by the gas burner 15, and an ignition sensor 23 for sensing whether the ignition of the gas burner 15 has been completed. Between the gas tank and the gas burner, a gas valve 13 for controlling the pressure of the gas supplied from the gas tank 11 is disposed. The gas valve 13 is controlled by a microprocessor 10. The temperature of the water sensed by the temperature sensor 21 and the completion of the ignition sensed by ignition sensor 23 are inputted to the microprocessor 10. Microprocessor 10 computes the time spent for supplying the gas by use of signals from the timer 25.

Figure 4:
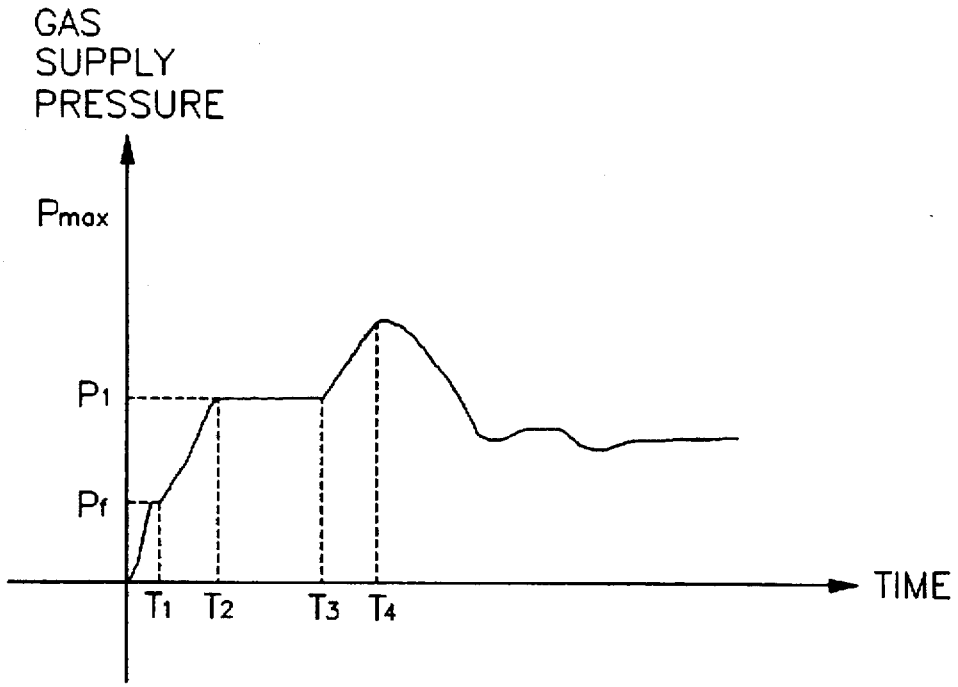
FIG. 4 shows a variation of gas supply pressure according to an embodiment of the present invention.
Figure 5:
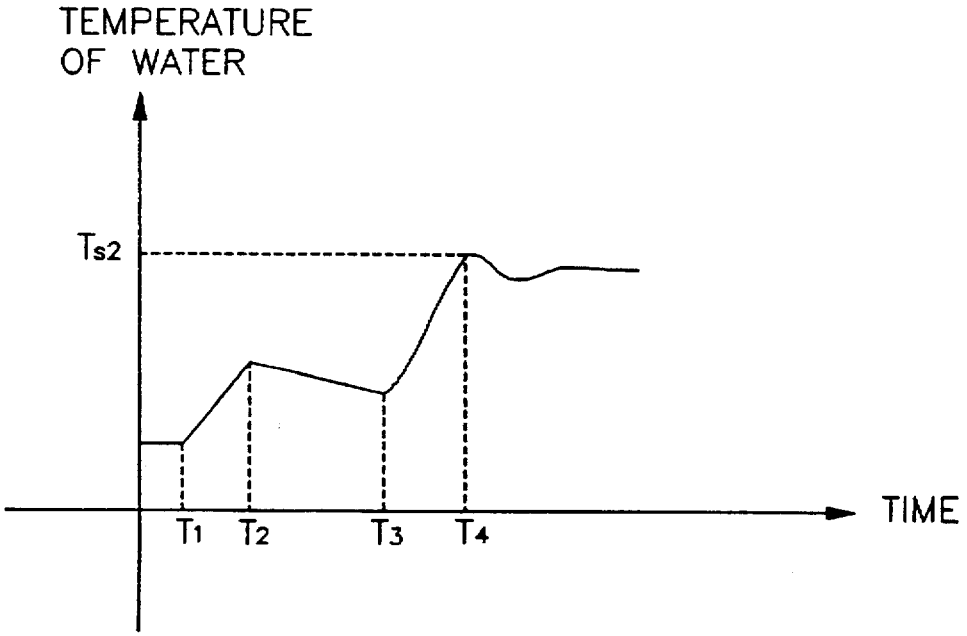
FIG. 5 shows a variation of the temperature of water in the gas boiler when the gas supply pressure is controlled as shown in FIG. 4.

FIG. 4 shows a variation of gas supply pressure according to an embodiment of the present invention, and FIG. 5 shows a variation in the temperature of the water in the gas boiler when the gas supply pressure is controlled as shown in FIG. 4. This embodiment illustrates the situation which the target temperature Ts2 set by user is low or the heating load of the gas boiler is small. A plurality of set pressures are inputted into the microprocessor 10. The set pressures are obtained by setting a predetermined number of pressure levels between the ignition pressure Pf and maximum gas supply pressure Pmax of the gas boiler. When the gas boiler begins to operate, the microprocessor 10 controls the gas valve 13 to supply the gas from the gas tank 11 to the gas burner 15. As shown in FIG. 4, the microprocessor 10 controls the gas valve 13 to gradually increase the pressure of the supplied gas, and the ignition device 17 to ignite the gas burner 15 at the time T1 when the gas supply pressure becomes greater than the ignition pressure Pf required to ignite the gas.

The ignition sensor 23 senses the ignition state and transmits the signals of sensing the ignition, and then the microprocessor 10 increases the gas supply pressure until the gas supply pressure reaches the first set pressure P1 by the microprocessor 10. The time of gas supply at the first set pressure P1 is counted by the timer 25. When the counted time becomes a preset time, the microprocessor 10 controls the gas valve 13 to increase the gas supply pressure. The temperature of water reaches the target temperature Ts2 while the gas supply pressure is increasing, and in that case, the microprocessor 10 lowers a gas supply pressure to the pressure corresponding to the target temperature Ts2. After that, the target temperature Ts2 is maintained by the proportional combustion control method shown in FIGS. 1 and 2.

The temperature of water is varied as shown in FIG. 5 by the above-described method. The temperature of water rises by degrees from the time T1 that ignition is completed to the time T2 that the gas supply pressure becomes the first set pressure P1. While the first set pressure P1 is maintained, the temperature of water is lowered a little as the water in the gas boiler is circulated, and if the amount of the circulated water is small or if the first set pressure P1 is high, the temperature of water may either remain constant or rise a little.

From the time T2 that the gas supply at the first set pressure P1 is completed, the temperature of water begins to rise again, and in some time water reaches the target temperature Ts2. After that, the target temperature Ts2 is constinuously maintained by the proportional combustion control method.

According to above-described method, since the temperature of water rises to the target temperature Ts2 before the gas supply pressure reaches the maximum gas supply pressure Pmax, the noise generated by combustion operation is reduced in comparison with the situation in which the gas is supplied by the maximum gas supply pressure Pmax from the time of initial operation of the gas boiler.

Figure 1:
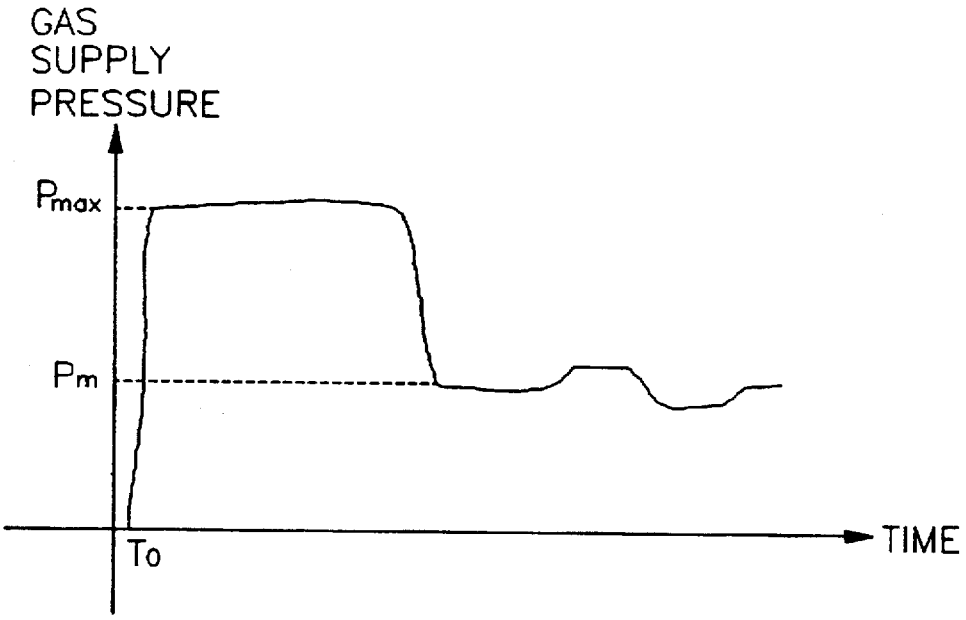
FIG. 1 PRIOR ART
FIG. 1 shows a variation of gas supply pressure according to a proportional combustion control method.
Figure 2:
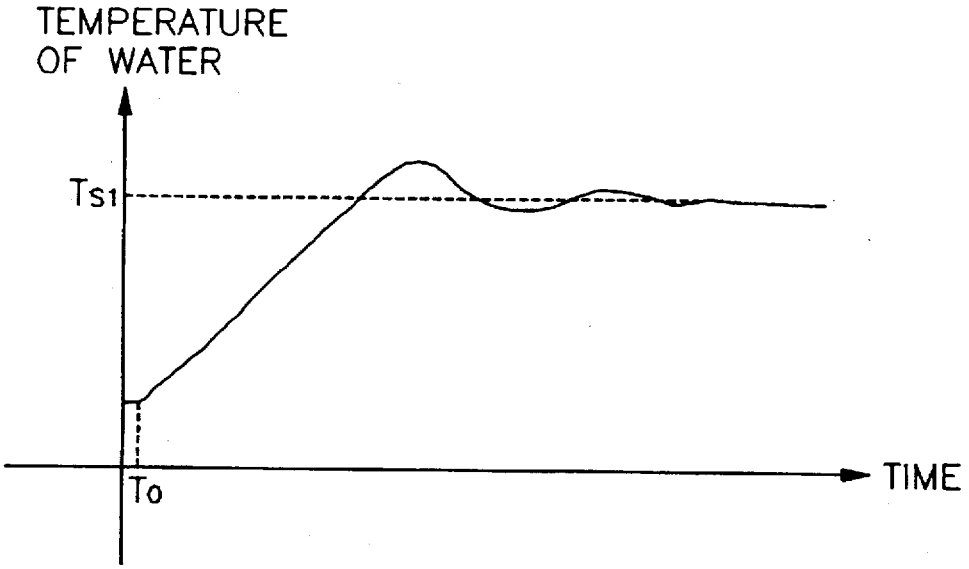
FIG. 2 PRIOR ART
FIG. 2 shows a variation of the temperature of water in the gas boiler when the gas supply pressure is controlled as shown in FIG. 1.
Figure 6:
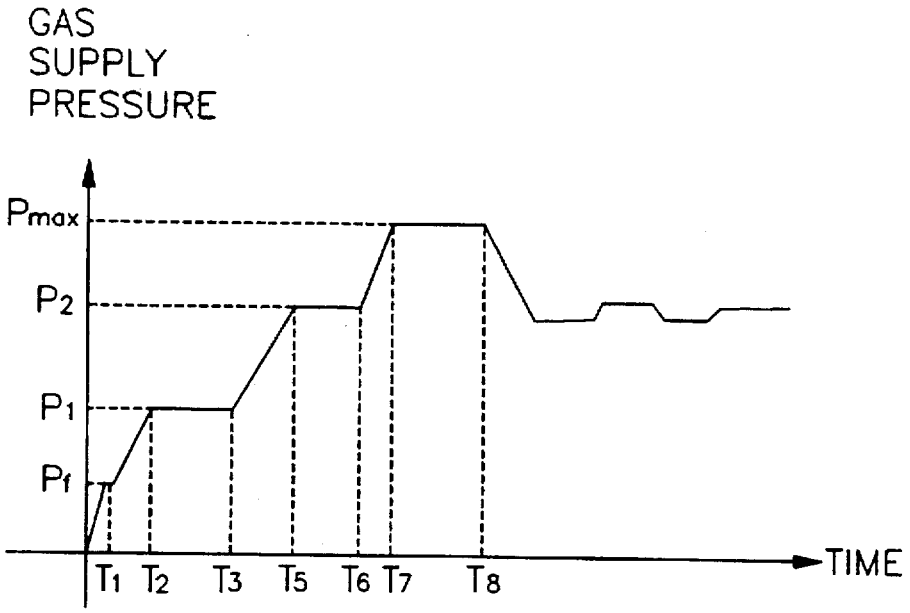
FIG. 6 shows a variation of gas supply pressure according to another embodiment of the present invention.
Figure 7:
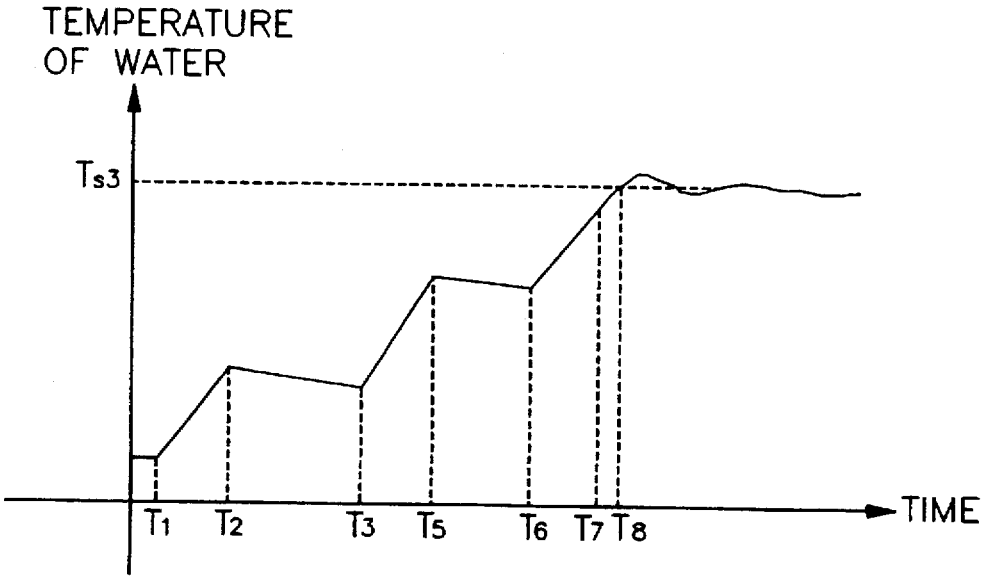
FIG. 7 shows a variation of the temperature of water in the gas boiler when the gas supply pressure is controlled as shown in FIG. 6.

FIG. 6 shows a variation of gas supply pressure according to another embodiment of the present invention, and FIG. 7 shows a variation of water in the gas boiler when the gas supply pressure is controlled as shown in FIG. 6. In the present embodiment, the situation is shown in which the target temperature Ts2 is high or the heating load of the gas boiler is great. In this embodiment, as in the embodiment shown in FIG. 4, the gas supply pressure is increased gradually after the ignition is completed. After the supply of gas at the first set pressure P1 during a preset time, the gas supply pressure is increased to the second set pressure P2. If the temperature of water does not reach the target temperature Ts3 after another preset time, the gas supply pressure is increased again to the maximum gas supply pressure Pmax. Thus, as shown in FIG. 6, a series of stepped increases in gas supply can be utilized to achieve a gradual increase in gas supply. If the temperature of water reaches the target temperature Ts3 during heating by maximum gas supply pressure Pmax, microprocessor 10 lowers the gas supply pressure to a pressure corresponding to the target temperature Ts3, and thereafter, performs gas supply control by the proportional combustion control method as illustrated in FIGS. 1 and 2.

The temperature of water varies as shown in FIG. 7 by the gas supply control described above. The temperature of water rises by degrees from the time T1 that ignition is completed to the time T2 that the gas supply pressure becomes the first set pressure P1. During the time that the first set pressure P1 is maintained, the temperature of water falls a little as the water accommodated in the gas boiler is circulated, and as in the case of the embodiment in FIG. 5, the temperature of water may either remain constant or rise a little. From the time T3 that the gas supply at the first set pressure P1 ends, the temperature of water begins to increase again until the point of time T5 that the gas supply pressure reaches the second set pressure P2. During the time that the second set pressure P2 is maintained, the temperature of water may fall. From the time T6 that the gas supply at the second set pressure P2 ends, the temperature of water begins to rise again and reaches the target temperature Ts3 during the gas is supplied at the maximum gas supply pressure Pmax. After that, the target temperature Ts3 is maintained by the gas supply control according to the proportional combustion control method.

According to above-described method, since the temperature of water rises near the target temperature Ts3 before the gas supply pressure reaches the maximum gas supply pressure Pmax, the duration time of maximum gas supply pressure Pmax is reduced in comparison with the situation in which the gas is supplied by the maximum gas supply pressure Pmax from the time of initial operation of the gas boiler, and thus the total noise which occurs due to combustion by maximum gas supply pressure Pmax is reduced.

The time interval in which the gas supply pressure rises from the ignition pressure Pf to the maximum gas supply pressure Pmax is predetermined in consideration of the heating capacity of the gas boiler, the noise reduction effect, and the delay of the rapid heating operation, etc. Preferably such a predetermined time is set about 30 minutes.

By adopting the method for gas supply control according to the present invention not only at the time of initial operation of the gas boiler but also during the operation of the gas boiler if the target temperature is heightened by the user, it is possible to reduce the noise not only at the time of initial operation of the gas boiler but also during the operation of the gas boiler.

Although in the embodiment shown in FIG. 6, the situation in which two set pressures P1, P2 are set is illustrated, it is possible to set more than two set pressures or only one set pressure. If only one set pressure is set, it is preferable that the set pressure is an average pressure of a combination of the ignition pressure Pf and the maximum gas supply pressure Pmax. Thereupon, it is possible to prevent a decline in the heating efficiency that may occur if the set pressure is too low, or to prevent a decline in the noise reduction effect that may occur if the set pressure is too high. Furthermore, it is possible not to set such a set pressure, but instead to increase continuously the gas supply pressure until the gas supply pressure reaches maximum gas supply pressure Pmax during the predetermined time of about 30 minutes.

If the user uses the gas boiler to acquire hot water instead of heating rooms, since rapid heating operation is preferred to reducing the noise, it is preferable not to adopt the method for gas supply control according to the present invention but to adopt the conventional proportional combustion control method from the time of initial operation of the gas boiler.

Furthermore, it is possible that the method for gas supply control according to the present invention can be adopted or not adopted alternatively by the user. That is, if the rapid heating operation is needed despite the generation of noise, it is preferable to make it possible to choose the proportional combustion control method. According to this, the use of the gas boiler becomes more convenient.

Figure 8:
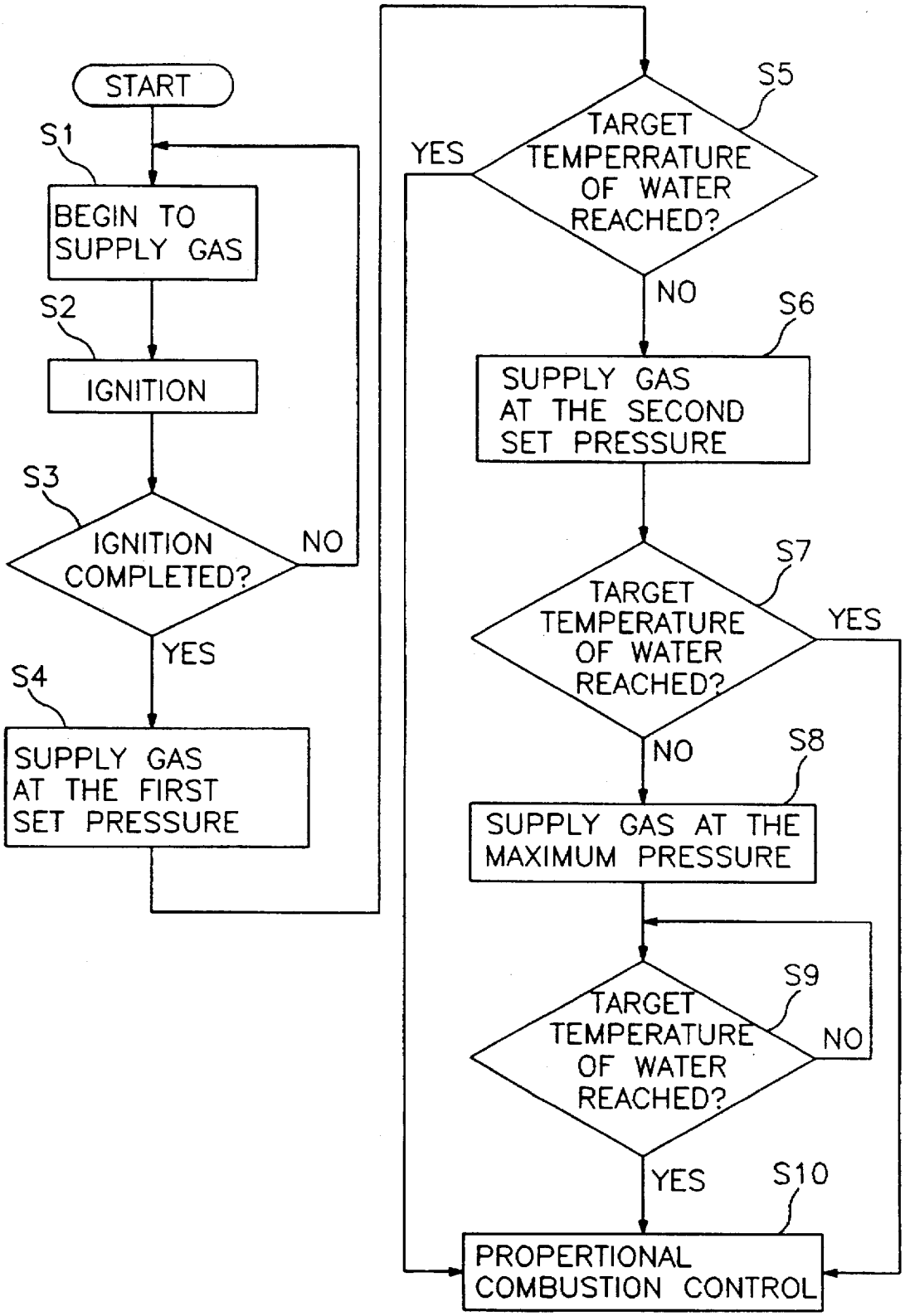
FIG. 8 is a flow chart of a method for gas supply pressure control according to the present invention.

Hereinafter, the method for gas supply control according to the present invention will be described with reference to the flow chart in FIG. 8. As the operation of the gas boiler begins, the supply of the gas to the gas burner 15 begins S1. After that, the ignition is performed S2, and the ignition sensor 23 senses the ignition S3. If the ignition is not completed gas step S1 and ignition step S2 will be executed again, and if the ignition is completed the gas supply pressure is increased to the first set pressure P1 S4. The temperature sensor 21 senses the temperature of the water S5. In case the temperature of water reaches the target temperature during the gas supply at the first set temperature P1, the proportional combustion control is performed S10, but if the temperature of water does not reach the target temperature after a preset time, the gas supply pressure increases to the second set pressure P2 S6. The temperature sensor 21 senses the temperature of water during the gas supply at the second set temperature P2 S7. If the temperature of water reaches the target temperature, the proportional combustion control S10 is performed, but if the temperature of water does not reach the target temperature after another preset time, the gas supply pressure increases to the maximum gas supply pressure Pmax. If the temperature of water reaches the target temperature during the gas supply at the maximum gas supply pressure Pmax, the proportional combustion control S10 is performed.

As described above, the gas boiler and the method for gas supply pressure control according to the present invention provides the effect that the noise resulting from combustion is reduced since the time that the gas is supplied at the maximum gas supply pressure is reduced at the time of initial operation and during the operation of the gas boiler.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A method for controlling gas supply of a gas boiler comprising the steps of:

supplying gas into a gas burner at a gas supply pressure which is higher than an ignition pressure for igniting the gas;

igniting the gas supplied into said gas burner;

gradually increasing the gas supply pressure during a predetermined time until a fluid to be heated reaches a target temperature set by a user, when the gas supplied into said gas burner is ignited; and supplying the gas at a corresponding gas supply pressure to the target temperature when a temperature of the fluid reaches the target temperature.

2. The method for controlling gas supply of a gas boiler as claimed in claim 1 wherein gradually increasing the gas supply pressure includes a series of stepped increases in gas supply pressure.

3. The method for controlling gas supply of a gas boiler as claimed in claim 1, wherein the predetermined time is about 30 minutes.

4. A method for controlling gas supply of a gas boiler comprising the steps of:

supplying gas into a gas burner at a gas supply pressure which is higher than an ignition pressure for igniting the gas;

igniting the gas supplied into said gas burner;

sensing whether ignition of the gas has been completed;

gradually increasing the gas supply pressure during a predetermined time until a fluid to be heated reaches a target temperature set by a user, according to a predetermined number of pressure levels which are between the ignition pressure and a maximum gas supply pressure of the gas boiler, when the ignition of the gas is sensed; and supplying the gas at a corresponding gas supply pressure to the target temperature when a temperature of the fluid reaches the target temperature.

5. The method for controlling gas supply of a gas boiler as claimed in claim 4, wherein the pressure levels are defined by an average pressure of a combination of the ignition pressure and the maximum gas supply pressure.

6. The method for controlling gas supply of a gas boiler as claimed in claim 4 wherein gradually increasing the gas supply pressure includes a series of stepped increases in gas supply pressure.

7. The method for controlling gas supply of a gas boiler as claimed in claim 4, wherein the predetermined time is about 30 minutes.

* * * * *